US005526107A

United States Patent [19]

Bronstein

[11] Patent Number: 5,526,107

[45] Date of Patent: Jun. 11, 1996

[54] COLOR PRINTING APPARATUS FOR PRODUCING DUPLEX COPIES

[75] Inventor: Rafail Bronstein, Kfar Saba, Israel

[73] Assignee: Scitex Corporation Ltd., Herzlia, Israel

[21] Appl. No.: 274,509

[22] Filed: Jul. 13, 1994

[51] Int. Cl.[6] ..... G03G 21/00

[52] U.S. Cl. ..... 355/319; 355/309; 355/327; 347/262

[58] Field of Search ..... 355/326 R, 327, 355/319, 309, 210, 24; 347/233, 232, 115, 262; 430/126

[56] References Cited

U.S. PATENT DOCUMENTS

| | | | |
|---|---|---|---|
| 3,947,270 | 3/1976 | North | 355/319 X |
| 4,264,183 | 4/1981 | Stoudt | 355/319 X |
| 4,591,884 | 5/1986 | Miyamoto et al. | 355/319 X |
| 5,410,384 | 4/1995 | Wachtler | 355/319 X |

FOREIGN PATENT DOCUMENTS 3-248170 11/1991 Japan .

*Primary Examiner*—Nestor R. Ramirez
*Attorney, Agent, or Firm*—Mark M. Friedman

[57] ABSTRACT

A color printing apparatus and method for printing separate color images onto the two sides of a substrate, which includes a number of image bearing cylinders, not necessarily of the same size, each of which is related to a single color and an imaging mechanism for imaging each of the cylinders with two separate images. The apparatus includes a number of transfer mechanisms for simultaneously transferring each of the images of each of the cylinders onto the substrate, with at least one of the images being transferred to each side of the substrate, and each of the images being transferred to the substrate from a different location along each of the cylinders. Finally, the apparatus includes a turnover mechanism for turning the substrate over between the transferring of the first of the images of all of the cylinders and the transferring of the second of the two images. A similar apparatus can also be used in monochrome printing using a single imaging cylinder. Both continuous-web and sheet-fed systems may be used.

25 Claims, 17 Drawing Sheets

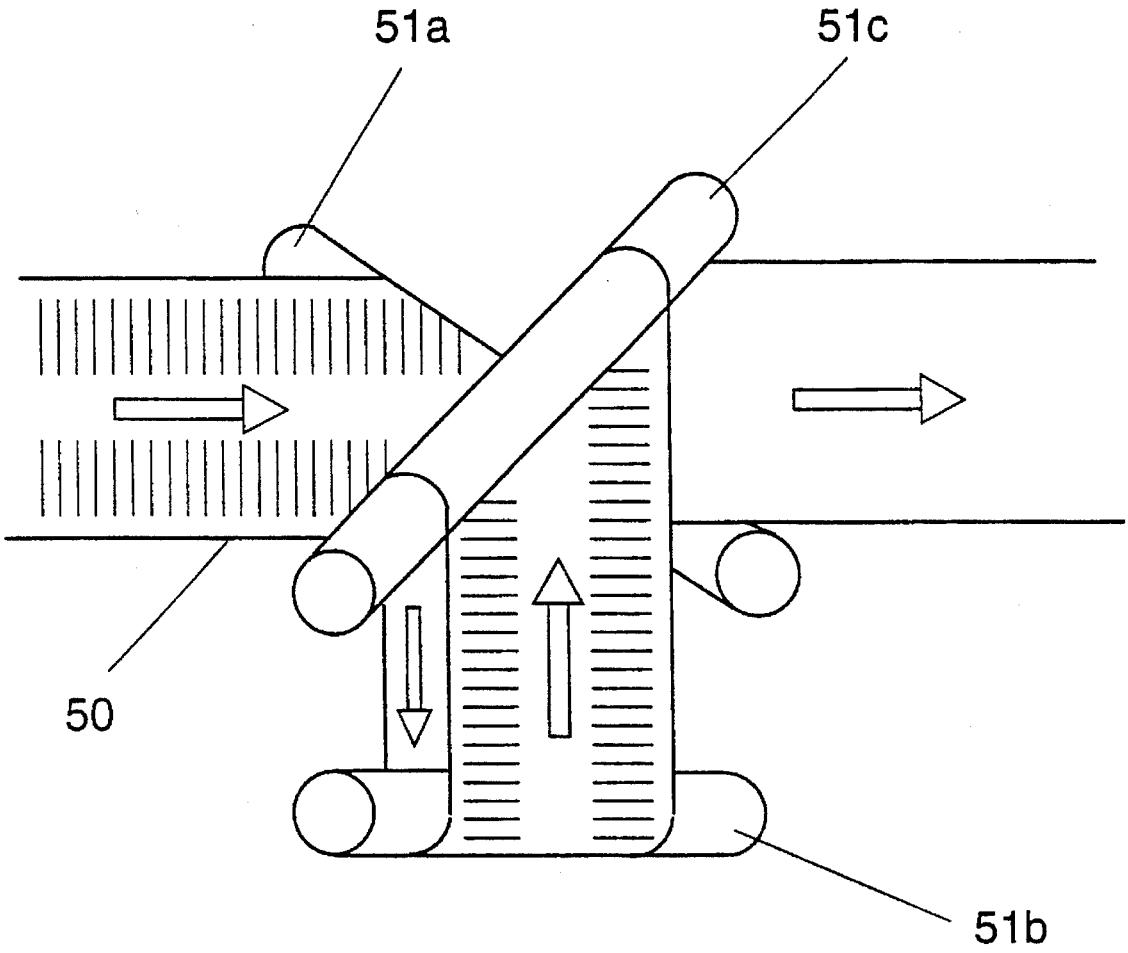
FIG. 5C PROIOR ART

COLOR PRINTING APPARATUS FOR PRODUCING DUPLEX COPIES

FIELD AND BACKGROUND OF THE INVENTION

The present invention relates to digital printing press apparatus and, more particularly, to digital printing press apparatus for printing separate images on both sides of the substrate.

A number of conventional printing press systems are shown in FIGS. 1–4. These systems typically include a number of printing units, designated 2 in FIG. 1. Each unit 2 includes an image bearing surface, typically a printing cylinder 4 which holds the plate with the inked image. In the course of its rotation, printing cylinder 4 transfers the image to a blanket cylinder 6. From blanket cylinder 6 the image is transferred to the upper surface 10 of a substrate 8, such as paper, under pressure provided by a pressure cylinder 12.

In monochrome printing, a single unit 2 is sufficient. Color printing systems require a number of units 2, with each unit 2 printing a single color, such as, for example, cyan, magenta, and the like, on one face 10 of the paper 8. When printing is required on both sides, 10 and 14, of paper 8, paper 8 must be turned over and re-fed into either the same press units 2, with a set of different plates, or into a similar in-line arranged printing unit 16 (FIG. 2). In either case, the in-line configurations described give the press a relatively large footprint, i.e., the press is relatively large and spread out, occupying a relatively large amount of space.

It is very commonly required, in both sheet printing and web (continuous roll) printing, to print on both sides of a substrate. To facilitate such two-sided printing, various systems, referred to generally as perfecting presses, have been developed.

As is illustrated in FIG. 3, the presses used in conventional perfecting systems have printing units 20 which include a pair of imaging/plate cylinders 22, each bearing a different image, and a pair of blanket cylinders 24 for transmitting the two images to the substrate 30. In this method printing is effected at the same time on both sides 26 and 28 of substrate 30 which may be, for example, paper sheet or web, with the pair of blanket cylinders 24 serving as each other's pressure cylinder. An improved perfecting press of the above-referenced construction is disclosed in U.S. Pat. No. 5,284,090 to Okamura et al. which is incorporated by reference in its entirety as if fully set forth herein.

Conventional digital printing presses have closely followed the established printing configurations. Conventional digital printing presses such as, the example, the Xerox Docutech, commercially available from Xerox Corp. of Rochester, N.Y., U.S.A., print only on one side of the paper and achieve a two-sided product through sequential printing methods similar to those described above.

More recently, ways have been proposed to print a plurality of images on the same substrate in sequential order but using the same imaging drum. These systems typically make use of a plurality of developing units, as can be seen, for example, in U.S. Pat. Nos. 4,860,053 to Yamamoto et al. and 5,278,615 to B. Landa et al., which are incorporated by reference in their entirety as if fully set forth herein.

For conventional four-color printing, these multipass printers are typically approximately four times slower, all other conditions being equal, than the so-called single pass color printers such as those described in U.S. Pat. No. 5,278,589 to L. Wong and 4,809,037 to Y. Sato, which are incorporated by reference in their entirety as if fully set forth herein. Should the need arise to print on both sides of the same paper sheet, the sheet with the first printed image is stored, turned over and re-fed into the machine, as is the case, for example, with the Xerox 5775 SSE digital color printer copier.

Shown in FIG. 4 is a configuration used in the Xeikon DCP-1 electronic press system, commercially available from Xeikon AB of Mortsel, Belgium, among others, for printing on both sides of the same paper web 40 using eight imaging cylinders 42.

Single pass printers as well as multipass printers which print images on both sides of the substrate require special arrangements to ensure that the images are properly synchronized or registered on the substrate. Various methods of registering the printed images have been developed. One illustrative example of such registration methods is disclosed in U.S. Pat. No. 5,278,587 which is incorporated by reference in its entirety as if fully set forth herein. It should be noted that these solutions generally work on paper sheet edges or require the positioning of special marks, which are not part of the printed image, on the substrate.

A method to improve image registration is disclosed in U.S. Pat. No. 5,280,362 to Noguchi, wherein two images pertaining to the same page are recorded at the same time on the same electrophotographic drum. The recorded images are also transferred at the same time to the paper sheet.

There is a widely recognized need for, and it would be highly advantageous to have, a digital printing press system which is capable of continuously and simultaneously (as that term is defined below) printing two different images in proper registration, one on each side of a substrate, using the same imaging cylinder.

SUMMARY OF THE INVENTION

According to the present invention there is provided a monochrome printing apparatus for simultaneously printing separate monochrome images onto the two sides of a substrate, comprising: (a) a single image bearing surface; (b) an imaging mechanism for imaging different portions of the single image bearing surface with at least two separate images; (c) a transfer mechanism for simultaneously transferring each of the at least two separate images onto the substrate, with at least one of the at least two images being transferred to each side of the substrate, each of the at least two images being transferred to the substrate from a different location along the image bearing surface; and (d) a turnover mechanism for turning the substrate over between the transferring of the separate images on different sides of the substrate.

Also according to the present invention, there is provided a color printing apparatus for simultaneously printing separate color images onto the two sides of a substrate, comprising: (a) a plurality of image bearing surfaces each of the surfaces being related to a single color; (b) an imaging mechanism for imaging each of the plurality of image bearing surfaces with at least two separate images related to the color printed by the image bearing surface; (c) a plurality of transfer mechanisms the simultaneously transferring each of the at least two separate images of each of the plurality of image beating surfaces onto the substrate, with at least one of the at least two images being transferred to each side of the substrate, each of the at least two images being transferred to the substrate from a different location along each of the plurality of image bearing surfaces; and (d) a turnover mechanism for turning the substrate over between the transferring of the first of the two images of all of the plurality of image beating surfaces and the transferring of the second of the two images.

Further according to the present invention there are provided methods for printing separate monochrome or color images onto the two sides of a substrate along the line described above.

According to further features in preferred embodiments of the invention described below, the substrate may be continuous-web or sheet-fed.

In addition to the above, in the present invention methods of image registration on different sides of the page or paper sheet are provided.

The current invention provides a method and apparatus of printing a different image on each side of a substrate, such as a paper sheet or web, using a single imaging cylinder. In addition, an apparatus and method according to the present invention significantly reduce the number of printing cylinders, which need not necessarily be of the same size, without sacrificing printing speed. Since both images are printed by the same color/pigment no precautions are needed to prevent pigment particles of one color from mixing with pigment particles of another color.

BRIEF DESCRIPTION OF THE DRAWINGS

The invention is herein described, by way of example only, with reference to the accompanying drawings, wherein:

FIG. 5*c* illustrates one of several methods of turning over a substrate web;

DESCRIPTION OF THE PREFERRED EMBODIMENTS

The present invention is of a method and apparatus for digital perfecting printing which can be used to accurately prim different images on the two sides of a substrate using a press of relatively small footprint.

The principles and operation of a digital perfecting printing method and apparatus according to the present invention may be better understood with reference to the drawings and the accompanying description.

Figure 1:
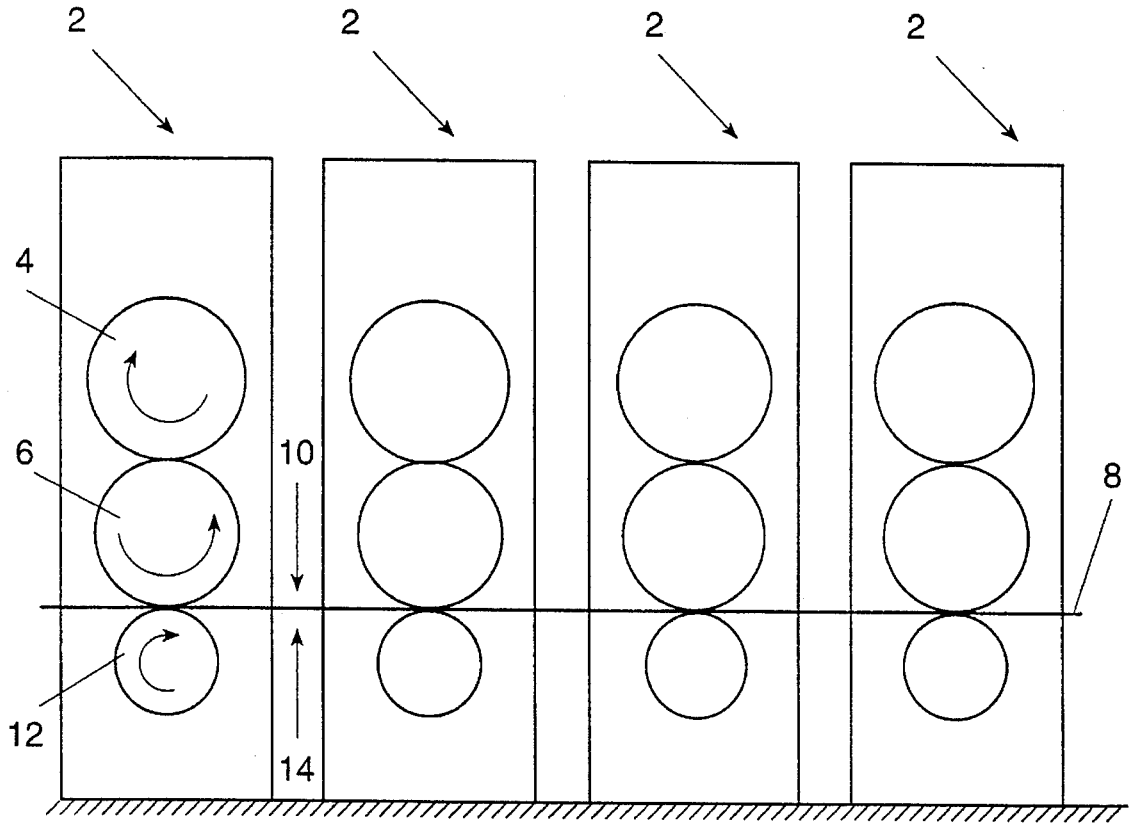
FIG. 1 PRIOR ART
FIG. 1 shows a prior an color offset printing press and illustrates one method for printing sequentially on both sides of the substrate.
Figure 2:
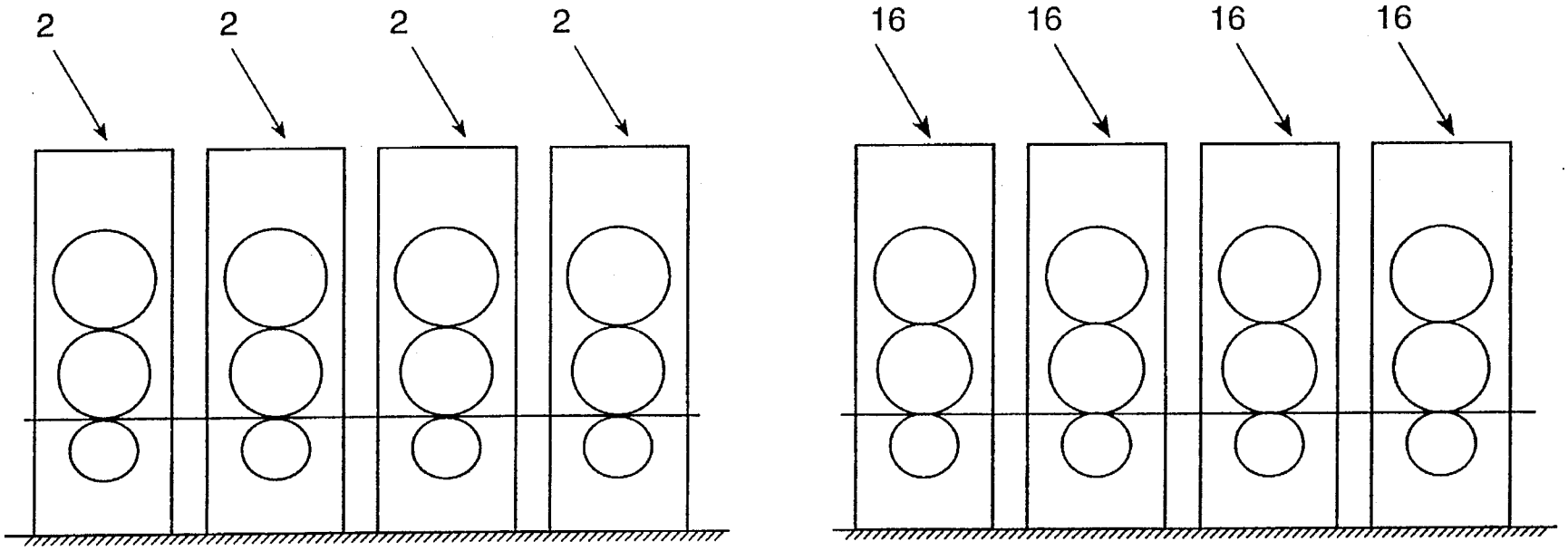
FIG.2 PRIOR ART
FIG. 2 illustrates another prior art method for color printing sequentially on both sides of the substrate.
Figure 3:
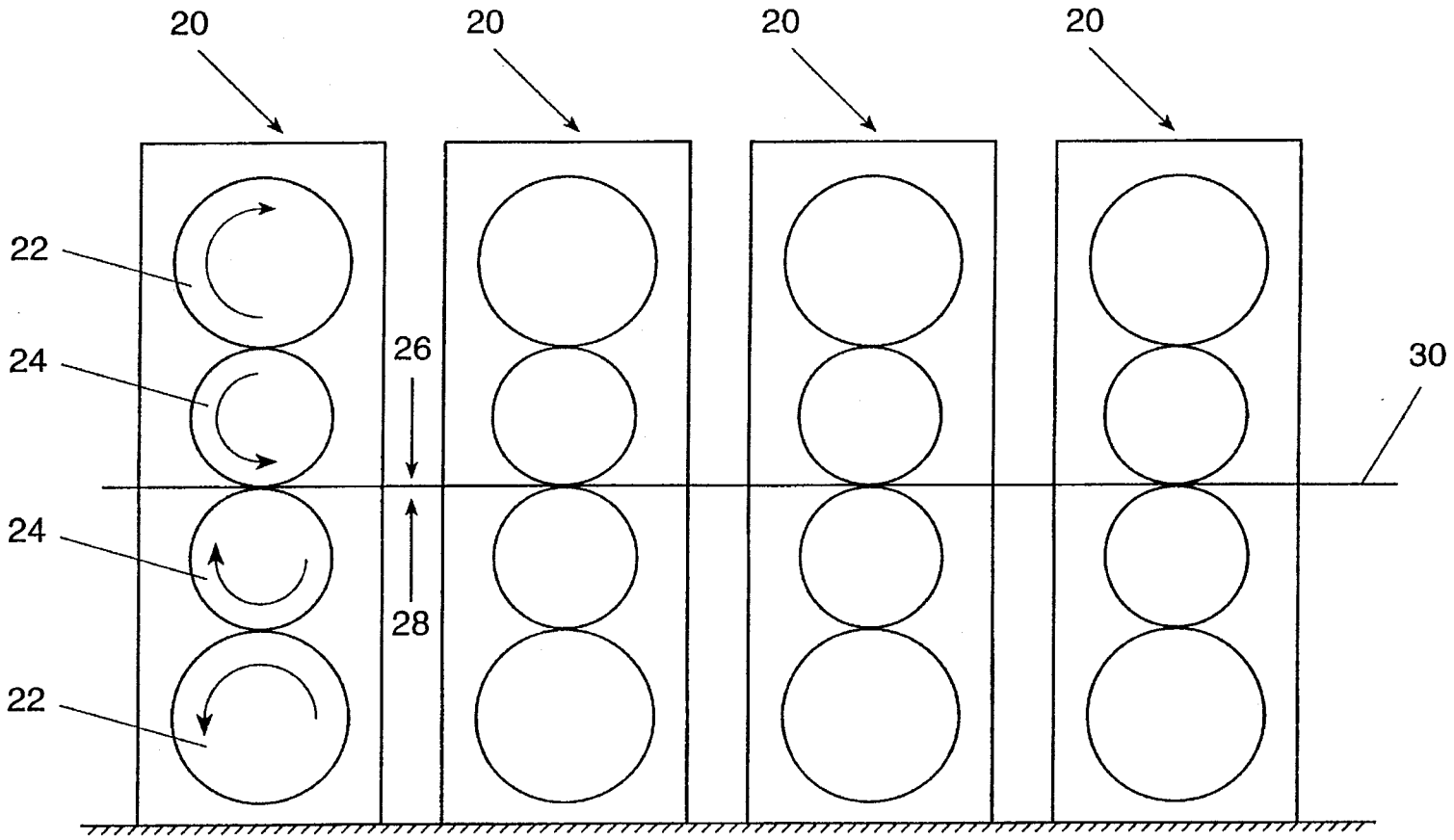
FIG.3 PRIOR ART
FIG. 3 illustrates a prior art method for printing on both sides of the substrate at the same time.
Figure 4:
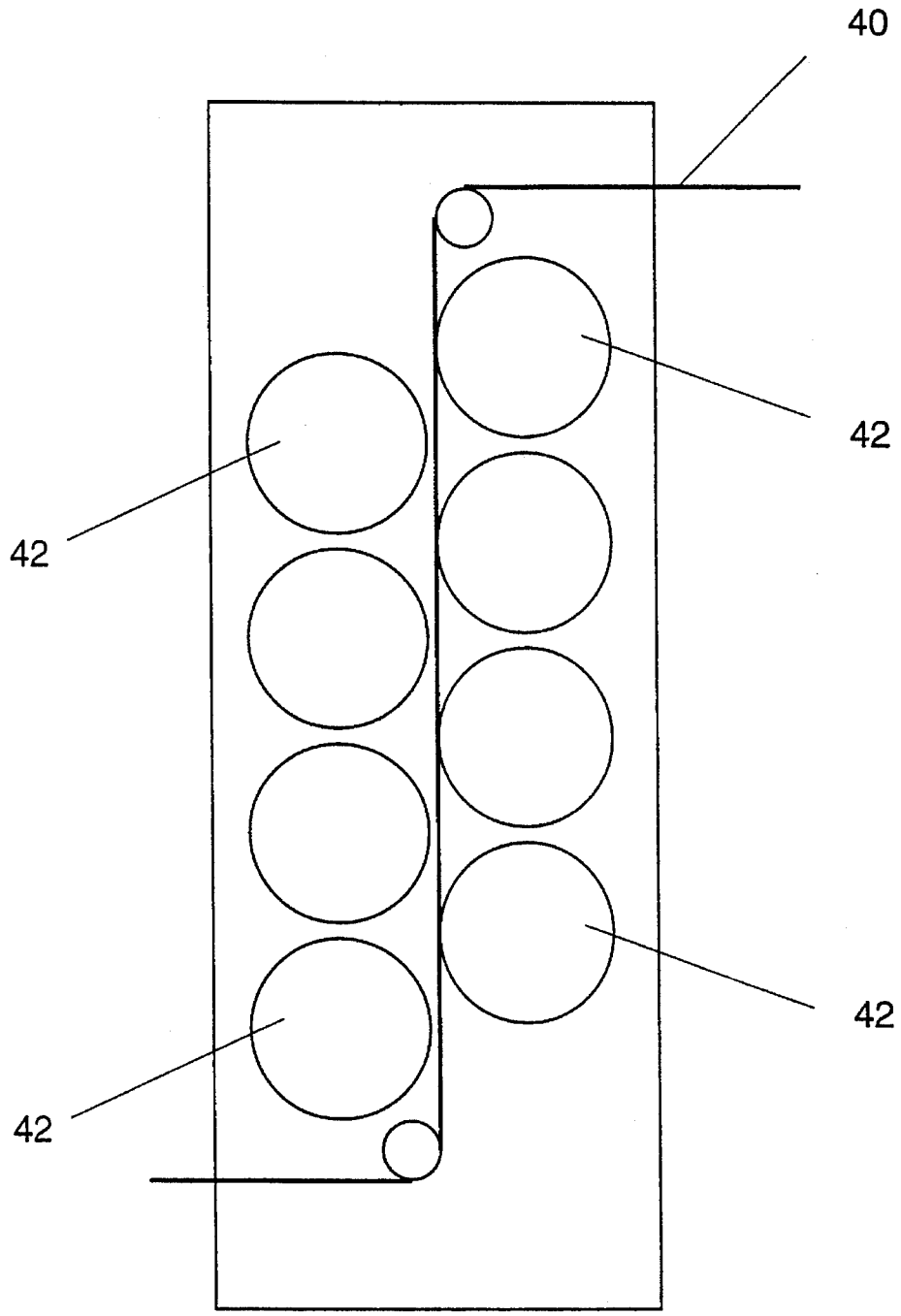
FIG. 4 PRIOR ART
FIG. 4 shows yet another prior art method for printing on both sides of a substrate at the same time.
Figure 5A:
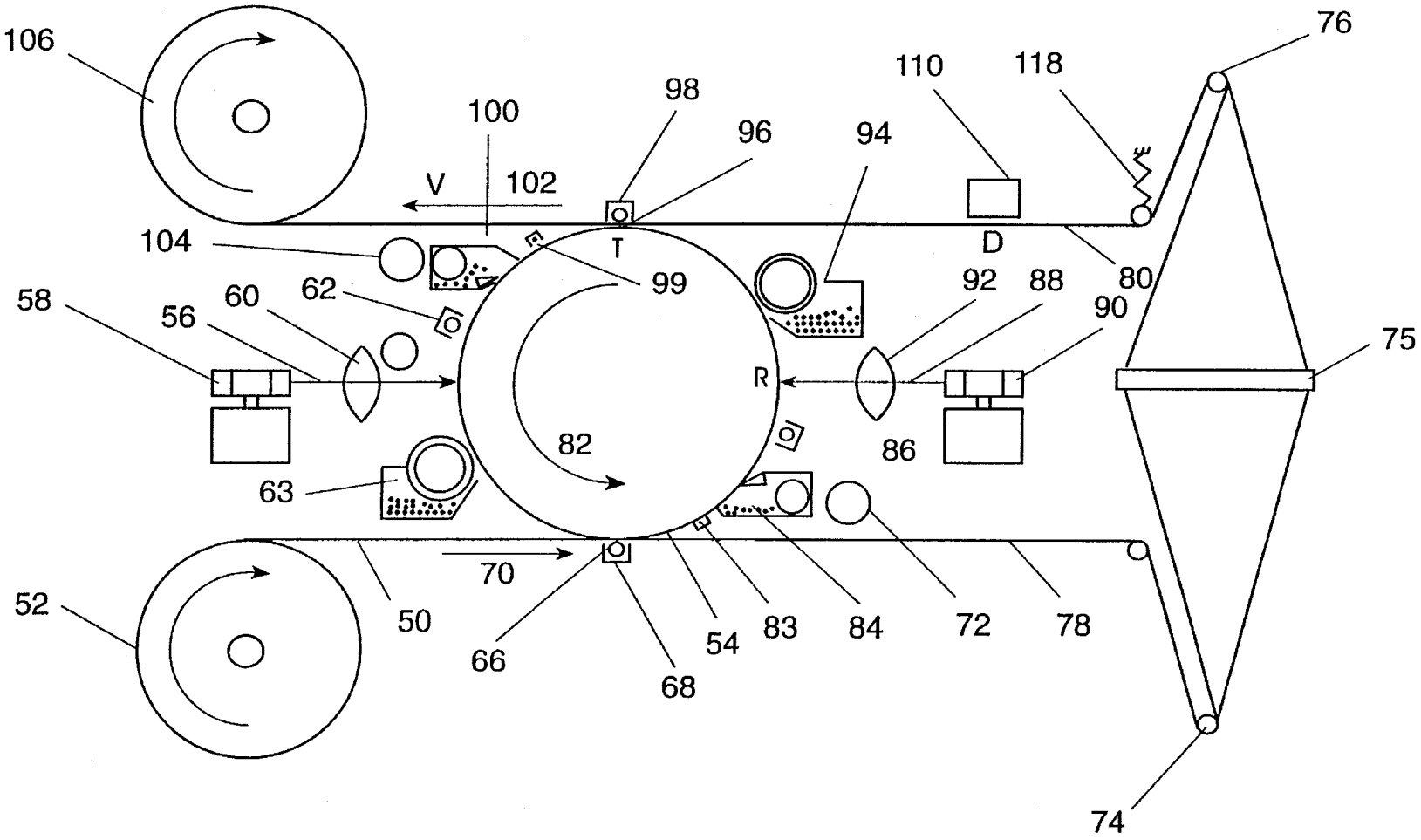
FIGS. 5*a* and 5*b* schematically depict in side view and top view, respectively, a basic version of a system and method according to the present invention.
Figure 5B:
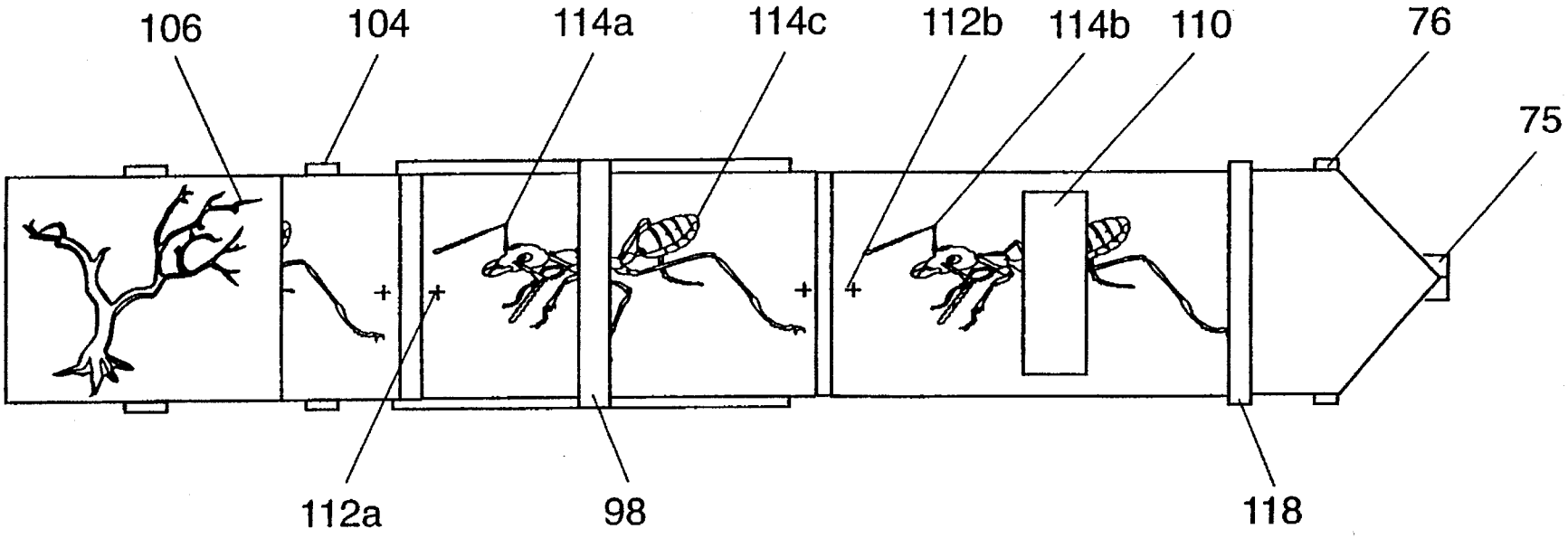

Referring now to the drawings, FIGS. 5*a* and 5*b* illustrate, in top side view and top view, respectively, the key features of a method and apparatus according to the present invention which is described in more detail below.

Substrate 50 is supplied to an image bearing surface, such as an imaging cylinder, or electrophotographic drum 54 from feed roll 52. The image, which may be of standard or non-standard size, is written onto a photosensitive drum 54, which rotates in the sense indicated by the arrow 82, using a light beam 56, such as a laser beam, which scans across the drum surface with the aid of a spinner, spinning polygon or oscillating mirror (hereinafter referred to singly or collectively as "spinner") 58. Light beam 56 is focused to a desired spot by an f-theta lens 60. Prior to imaging, drum 54 is uniformly charged by a corona charging device 62. The latent image is developed using a conventional developing device 63 and transferred to substrate 50 at a transfer point 66 with the help of an additional electrical charge provided by a transfer corona discharge device 68.

As will be readily appreciated, systems and methods according to the present invention may be used based on image bearing surfaces which are not photosensitive but which are instead sensitive to magnetic forces from a magnetic head, electrical charges as from an ion source, and the like.

As substrate 50 continues to move in the direction indicated by the arrow 70, the toned image is fixed by a flash fuser 72. Further down, the substrate web passes a system of turnover bars 74, 75 and 76 which serve to turn over substrate 50 so that the newly printed surface 78 now faces away from electrophotographic drum 54. The turning over of substrate 50 can be effected in a number of ways. For illustrative purposes, FIG. 5*c* depicts one such method of turning over substrate 50 which involves the use of three rollers 51*a*, 51*b* and 51*e* and which does not result in a change in direction of the substrate web. To bring substrate 50 back to the left toward drum 54, a pair of parallel rollers (not shown) placed perpendicular to substrate 50 would be used to direct substrate 50, which leaves to the right in FIG. 5*c*, up and then to the left.

As drum 54 continues to rotate the remaining, or residual, charge is removed by a discharge corona 83 and the drum is cleaned by a cleaning device 84 such as a vacuum or a mechanical scraper and is charged by a corona charge 86. Drum 54 is then imaged using a different image with the help of a spinner 90 which causes a light beam 88 to scan drum 54. Light beam 88 is imaged to a proper spot size by an f-theta lens 92. The image recorded is developed using a developing device 94 and is covered by toner which is then transferred to the clean surface 80 of substrate 50 at the printing/transfer area 96 with the help of a transfer charge provided by a corona device 98. As substrate 50 continues to move in the direction indicated by arrow 102, the toned image is fixed by a fusing device 104 and the paper is collected by a take up roll 106. As can be seen in FIG. 5*b*, when substrate 50 is gathered by take up roll 106 it is the second-primed image (of a tree) which appears on the outside surface of take up roll 106 while the first-printed image (of an ant) faces the core of take up roll 106.

As electrophotographic cylinder 54 continues to rotate in the direction indicated by arrow 82 the residual charge is removed from drum 54 by a discharge device 99 and drum 54 is cleared by a cleaning device 100, similar to cleaning device 84, so as to be ready for the next imaging cycle.

As will be readily apparent, the images involved may be of standard or non-standard (or endless) size.

As will also be readily apparent, the transfer of images from the image drum to the substrate need not take place directly but may, instead, be effected indirectly through one or more additional drums. For ease of presentation, only direct image transfer systems are described herein, it being understood that both direct and indirect image transfer systems are encompassed within the scope of the present invention.

It is to be noted that the process described herein causes the printing of two separate images at substantially the same time, with one of the images being printed on one side of the substrate and with the other image being printed on the other side of the substrate, albeit at a location which is somewhat displaced from the location of the first image. For convenience, such printing is described in the specification as well as in the claims as a 'simultaneous' transfer of two images onto the two sides of a substrate, even though the imprinting of two sides at a particular location along the substrate with images takes place sequentially rather than at the same time.

The positions of the printed images on the two sides of a substrate web or sheet may be synchronized by various mechanical means or by a suitable synchronizing circuit which receives its input from an optical sensor 110. Sensor 110 detects the position of the special marks 112 or an area of the image 114 itself whose coordinates, i.e., position on the paper, are known. The synchronization may be performed by proper timing of the image writing beam 88 or by varying the tension of the substrate web by using, for example, a dancing roller arrangement 118 which allows the length of substrate between two points to be varied.

When the mark 112a or the designated area of the image/text 114*a* is detected by detector 110 the detection signal is sent to a computer. The computer calculates the delay in the operation of the recording beam 88. The delay is the difference between the time it takes to the area D of the web surface 80 to which the image should be transferred and the time the first recorded line R by the beam 88 will come into the transfer area T. It is assumed that the relative position between the area "D" on web surface 80 to which the recorded image should be transferred and mark 112*a* or point of interest 114*a* is known, usually from the imposition sequence used to prepare the page, and resides in the memory of the computer.

The detection distance DT should preferably be larger than the distance between the recording point R and the transfer point T (length of the art RT of recording cylinder 54).

Figure 5D:
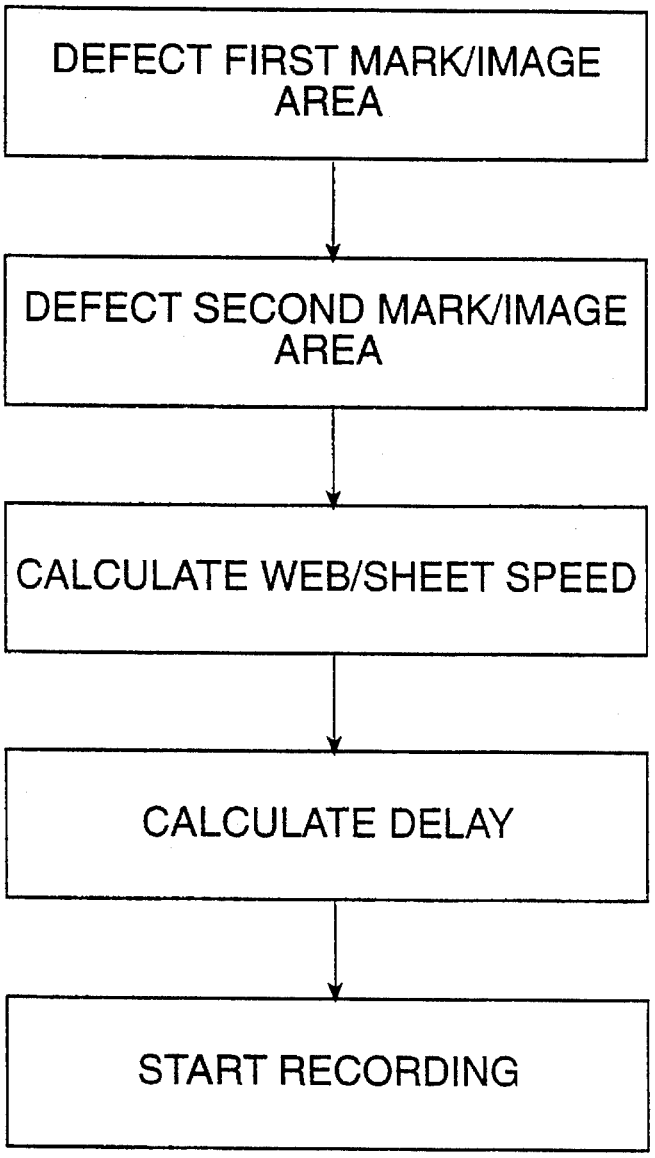
FIG. 5*d* depicts, in flow diagram form, a typical synchronization or registration scheme.

The distance DT is usually known from the geometrical parameters of the machine and the delay is calculated according to the equation $$(DT—RT)/V$$

where V is the actual web speed that may be determined by measuring the time between two successive registration points, e.g., between marks 112*a* and 112*a* (mark-to-mark) or between points of interest of the image 114*a* and 114*b* (image-to-image) or between mark 112*a* and a point of interest 114*a* or the image, or between point of interest of the image 114*a* and another point of interest 114*c*. The distance RT is a function of the relative position of the recording point R on cylinder 54 circumference with respect to the transfer point T. DT is given by $k\pi d$, where d is the cylinder diameter and k gives the ratio of the arc DT length to the full 360° cylinder circumference. A typical sychronization, or registration, scheme, such as that described above, is depicted in block diagram form in FIG. 5*d*.

Figure 6:
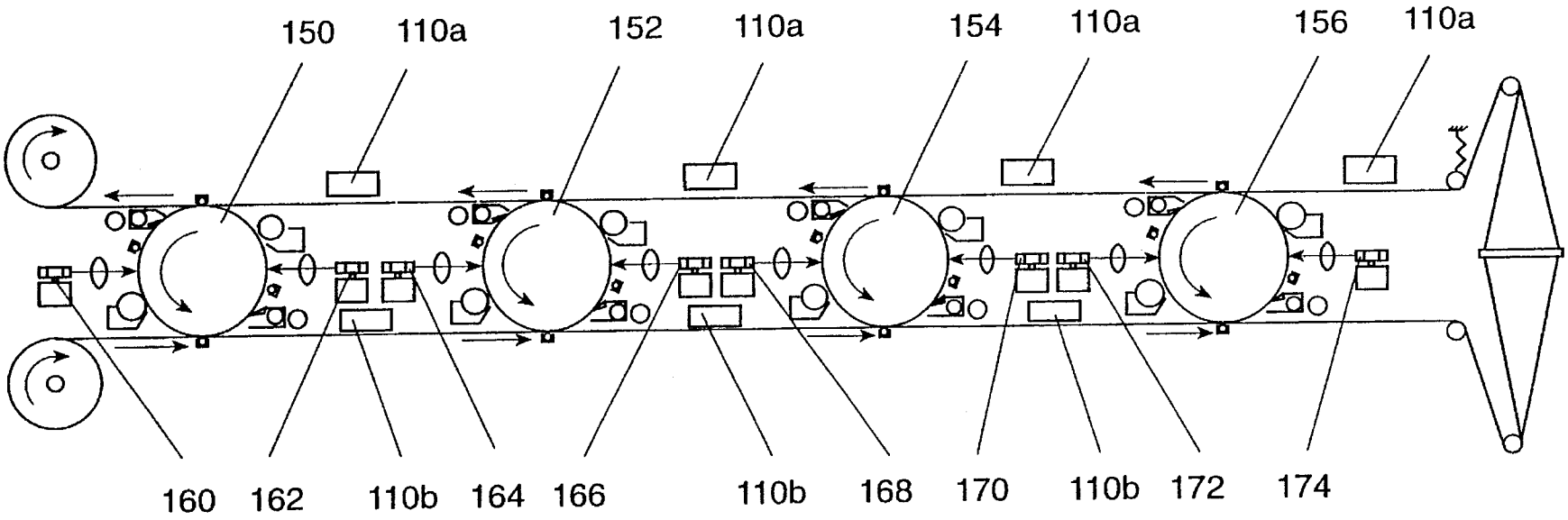
FIG. 6 shows a system according to the present invention featuring a number of priming cylinders.
Figure 6A:
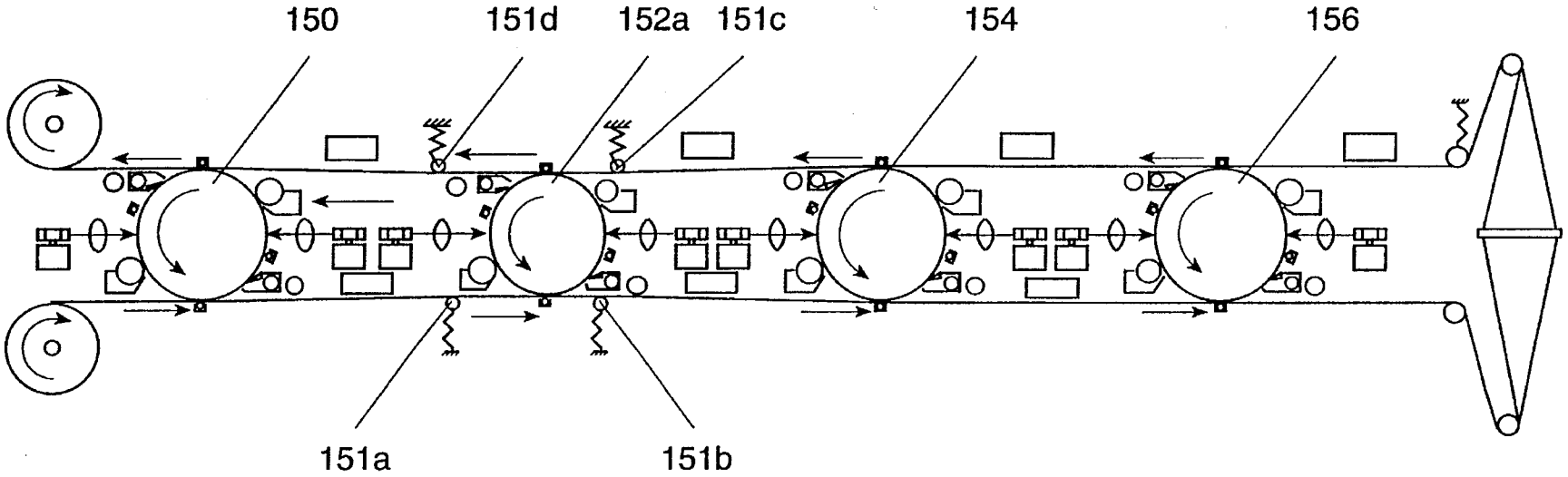
FIG. 6*a* shows a system as in FIG. 6 but having cylinders which are not all of the same diameter.

As will be readily apparent, a method and apparatus according to the present invention may be used with printing presses having more than a single printing cylinder. Shown in FIG. 6 is a system according to the present system using four printing cylinders 150 to 156. Such an arrangement is useful in color printing where each of the printing cylinders is dedicated to a different color, e.g., cyan, magenta, yellow, black or any other color or combination of colors. It is to be noted that each of printing cylinders 150 to 156 is dedicated to a single color. Thus, both images of the same color are printed by the same color/pigment, eliminating the need for precautions to prevent toner particles corresponding to one color from mixing with pigment particles of another and making it easier to recycle residual toner.

In the multi-cylinder configuration of FIG. 6 the imaging on each of the cylinders 150 to 156 is performed using a pair of laser beams spun across the respective cylinder surface using a pair of spinners 160/162, 164/166, 168/170 and 172/174 and imaged to at proper spot size by the corresponding f-theta lenses.

In this multicylinder configuration the registration/synchronization of the position of the images to be printed on both sides 70 and 80 of web 50 may be achieved using sensor 110*a* before each printing cylinder. Further to this registration of color to color on the same image cyan, magenta, yellow and black may be achieved using similar synchronization technique and sensors 110*b* similar to sensor 110.

Generally, the printing machines are constructed with the printing cylinders of equal diameter. This places the burden of registration problem on the mechanical accuracy of the machine and forces the vendors of such machines to use a single shaft to drive all four photoconductor drums.

The above-described active registration/synchronization method allows to use cylinders of different sizes. In this case, the diameter of each particular cylinder will be loaded into the lookup table following its installation in the machine and the appropriate delay will be calculated for every page/image.

For illustration, FIG. 6 shows a system of four printing cylinders, one of which (152*a*) is smaller than the others. A set of rollers (151*a*–151*d*) serve to properly direct the substrate onto the surface of cylinder 152*a*.

Thus, during the service/maintenance of the machine there will be no need to replace all four cylinders simultaneously since compensation for each cylinder size may be introduced in the process.

Figure 7:
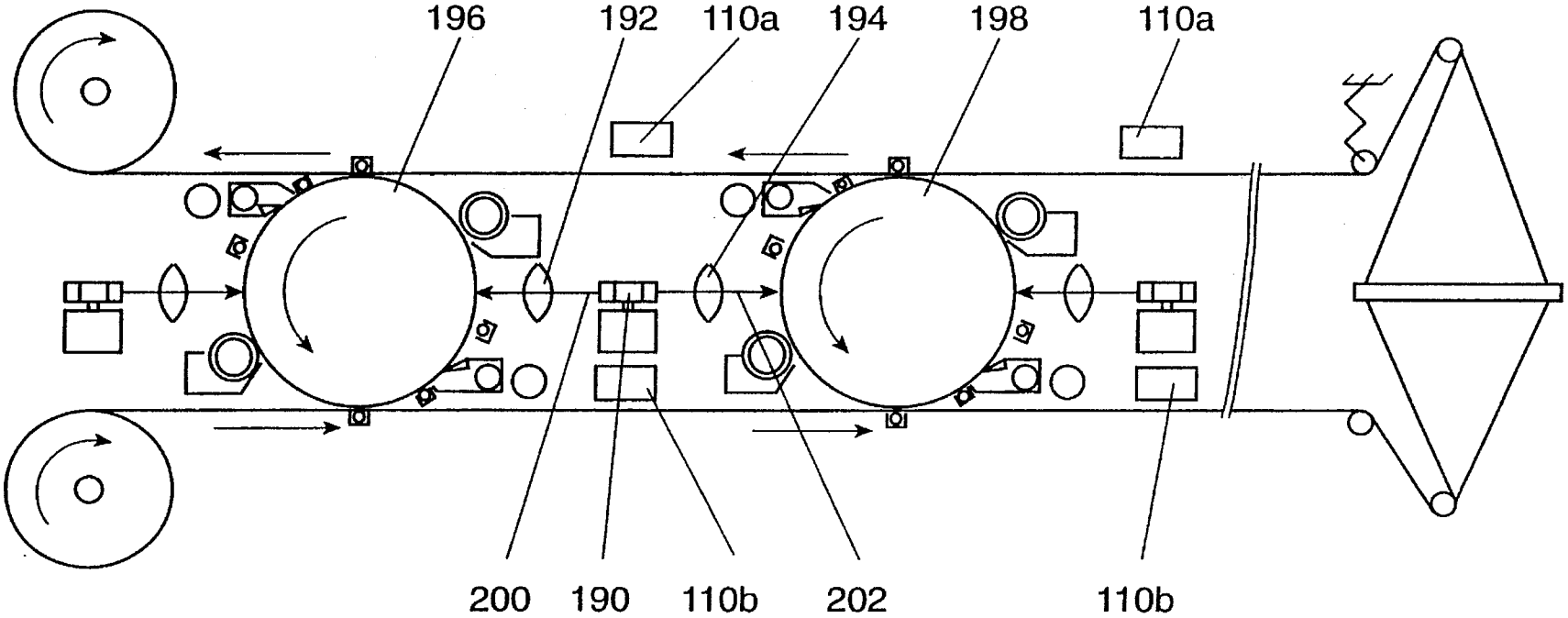
FIG. 7 shows a multi-cylinder system according to the present invention using a single spinner between each pair of rollers.

As is illustrated in FIG. 7, the arrangement of FIG. 6 may be further simplified by using only a single spinning mechanism 190 with each pair of f-theta lenses 192 and 194 to image respective imaging cylinders 196 and 198, similar to the arrangement in a different context disclosed in U.S. Pat. No. 5,280,362 to Noguchi. The synchronization of the writing process may be performed in a way which is similar to that described above, i.e., by proper timing of the writing beams 200 and 202 or by varying the tension of the substrate paper web using a dancing roller mechanism which can be a part of each writing station.

While the present invention has been described primarily with reference to a web system featuring a continuous substrate, the method and apparatus according to the present invention may beneficially be applied also to a sheet fed system.

Figure 8A:
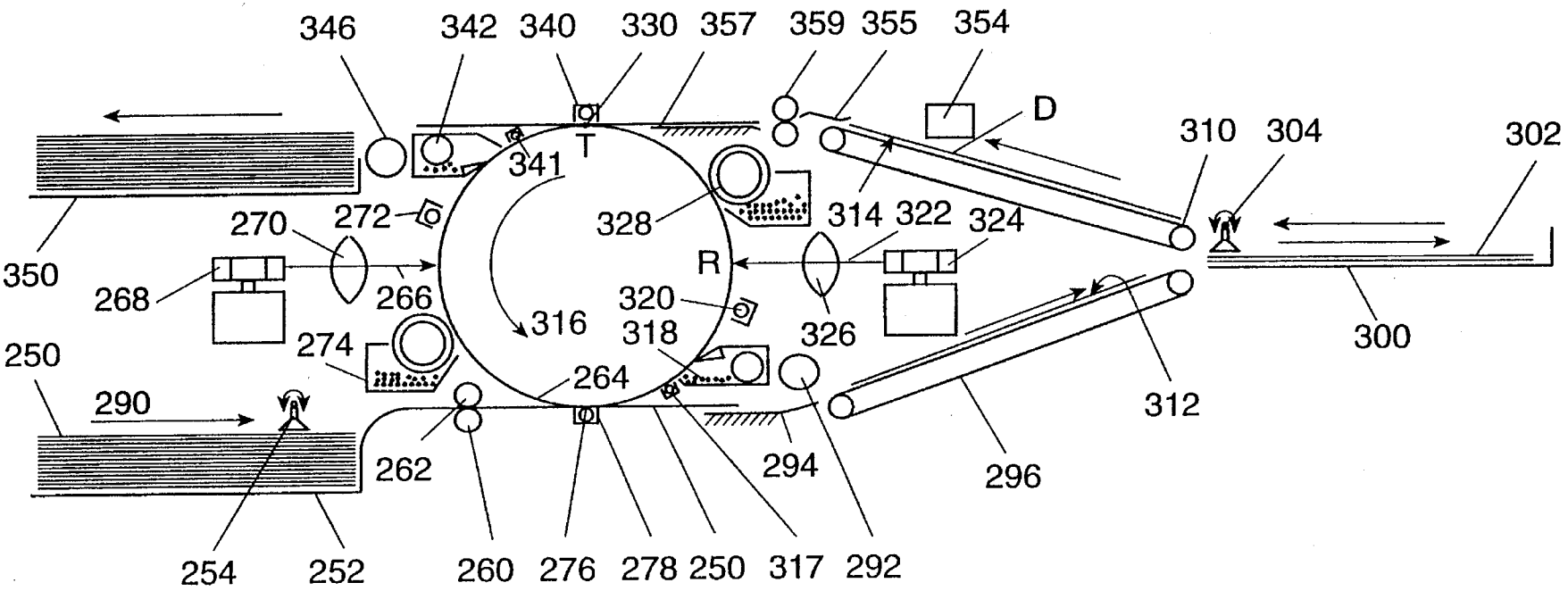
FIGS. 8*a* and 8*b* depict in side view and top view, respectively, a system according to the present invention in use with a sheet fed system.
Figure 8B:
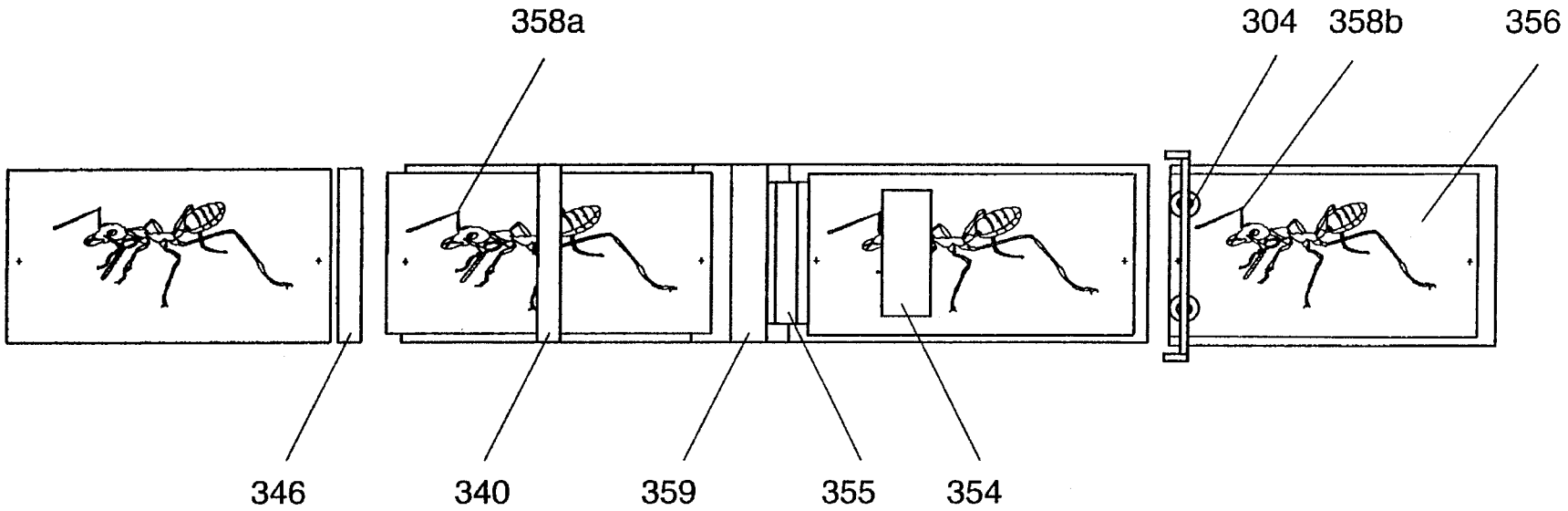
Figure 9A:
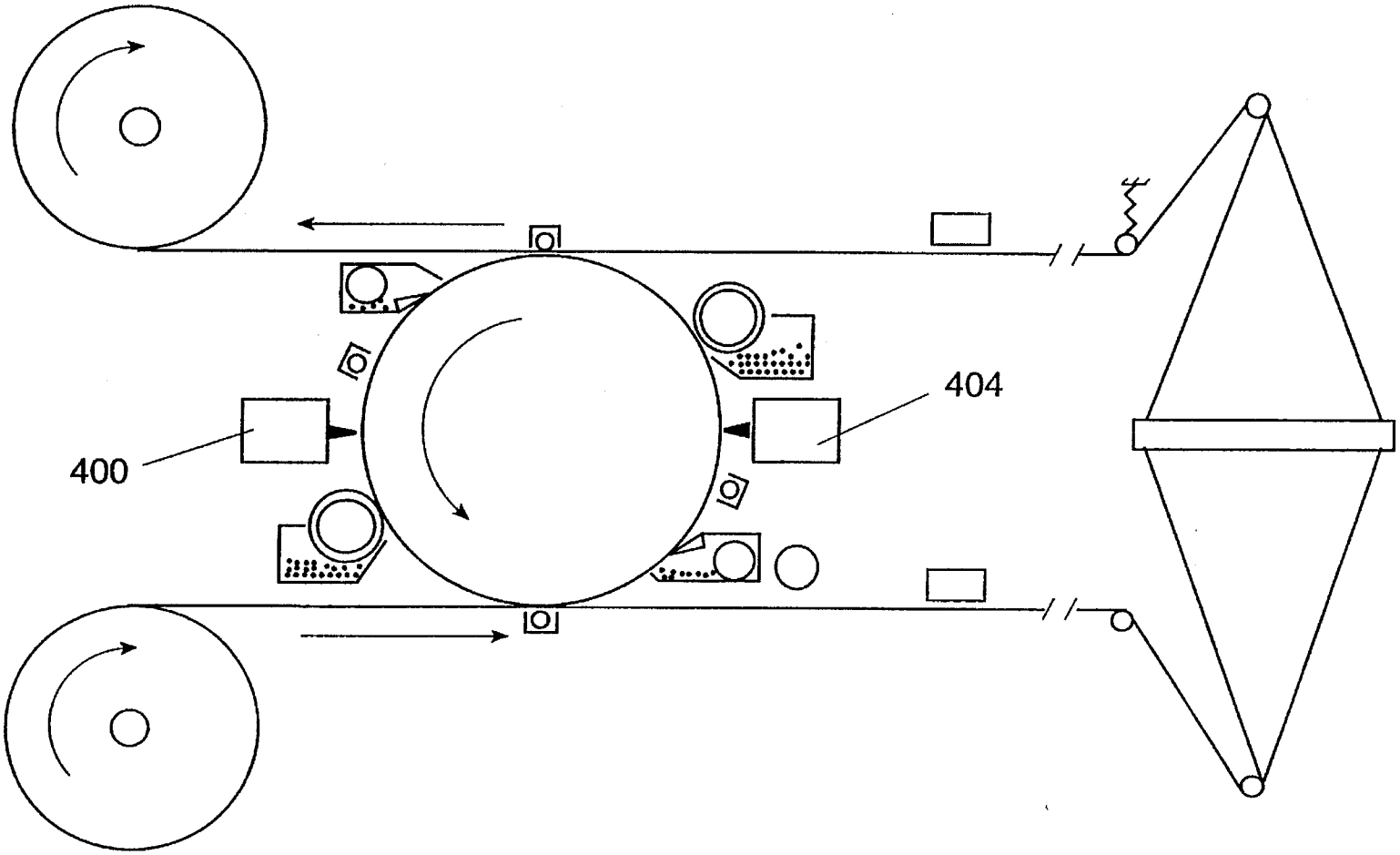
FIGS. 9*a* and 9*b* show in side view and top view, respectively, another embodiment according to the present invention wherein the laser beam with the associated spinner and f-theta lens have been replaced by LED arrays.
Figure 9B:
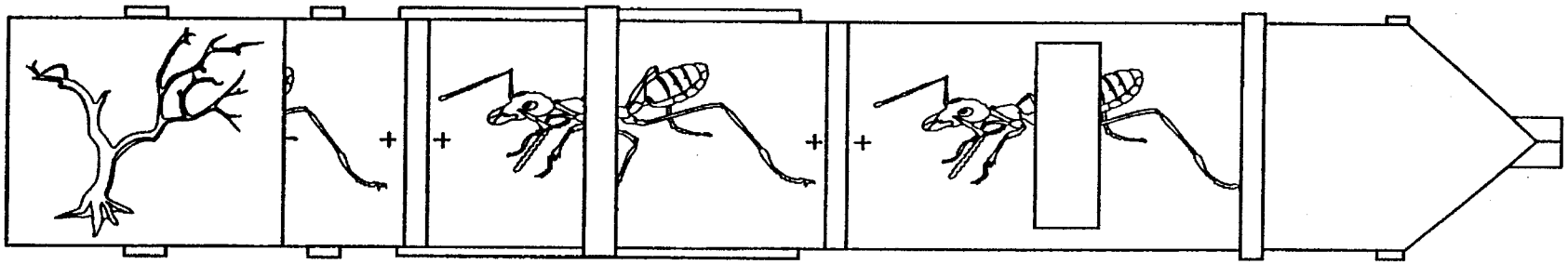
Figure 10A:
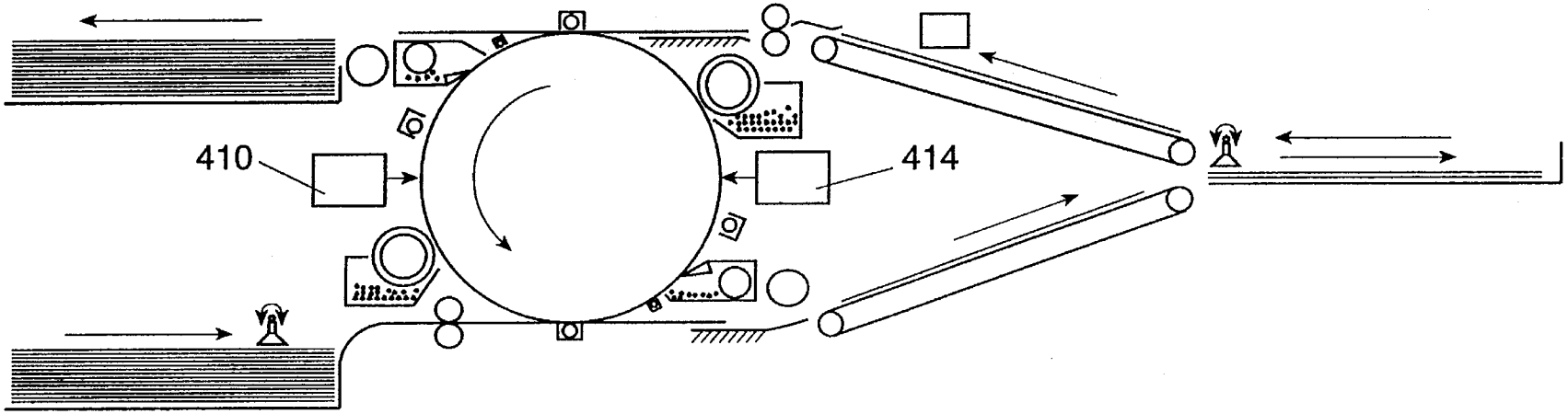
FIGS. 10*a* and 10*b* show a system as in FIGS. 9*a* and 9*b* but for use with a sheet fed system.
Figure 10B:
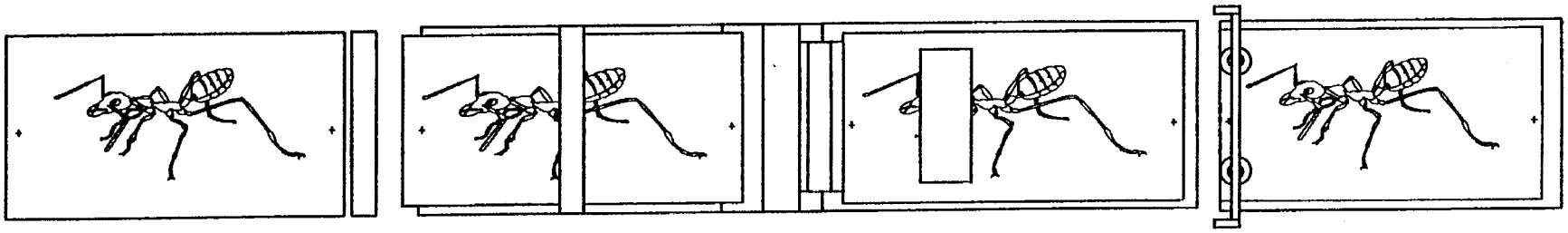

An example of the application of the present invention to a sheet fed system is illustrated in FIGS. 8*a* and 8*b*. Here, the substrate 250 is supplied from a pick-up tray 252 by an array of vacuum pick-up cups 254 or a pick-up roller (not shown) to a pair of paper guiding and moving rollers 260 and 262. Substrate 252 is then directed to electrophotographic drum 264.

The image is written on the drum by a light beam 266 scanned across the drum surface by a spinner 268 and focused to a desired spot size by an f-theta lens 270. Prior to imaging, the drum is uniformly charged by a corona charge device 272. The latent image is developed using a conventional developing device 274, is toned, and transferred to substrate 250 at a transfer point 276 with the help of an additional electrical charge provided by a transfer corona charge device 278.

As substrate 250 continues to move in the direction indicated by the arrow 290, the toned image is fixed by a flash fuser 292. Further down, the sheet of substrate 250 is diverted by a folding bracket 294, picked up by a conveyor 296 and fetched to an interim substrate storage tray 300. The number of substrate sheets temporarily housed on tray 300 may be variable, as desired by the operator, or minimal, to compensate for the delay caused by the movement of the paper from one printing position to another. In general, the delay should be as long as the time required for the one-side imaged paper sheet to get to interim paper storage tray 300 and from there to the printing area 330. In some cases, it may be desirable to collect a certain number of one-side printed pages in interim storage tray 300 to act as a buffer and effect a delay whose length is controllable by the user.

From the interim substrate storage tray 300 the substrate sheet 302 is picked up by an array of vacuum pick-up cups 304, similar to cups 254, and placed on conveyor 310 in such a way that newly printed surface 312 of substrate 250 faces away from electrophotographic drum 264 and the other substrate side 314 is brought into printing area 330 with the help of folding guiding brackets and pick-up rollers 359.

Electrophotographic drum 264 continues to rotate in the direction indicated by the arrow 316. The residual charge is removed from drum 264 by a discharge device 317 and drum 264 is cleaned by a cleaning device 318 such as a vacuum or mechanical scraper, charged by a corona charge 320 and imaged using a different image with the help of a scanning beam 322. Beam 322 is swept across the cylinder 264 surface with the help of a spinner 324 and is imaged to a proper spot size by an f-theta lens 326. The image recorded is developed and toned by a developing device 328. The toner is transferred to a paper surface 314 at the printing/transfer area 330 with the help of a transfer charge provided by the corona discharge device 340. Electrophotographic cylinder 264 is discharged by a discharge device 341 and cleaned by a cleaning device 342 and prepared for the next imaging cycle. As substrate 250 continues to move in the direction indicated by arrow 344 the toned images are fixed by a fusing device 346 and substrate sheets 250 are collected in a take up tray 350.

The synchronization of the position of the printed images on both sides of a substrate sheet may be achieved either mechanically using the paper sheet edge or by using a synchronizing circuit which receives its input from an optical sensor 354 which senses the position of the special marks 356 or an area of the image 358 itself whose coordinates are known. The synchronization process proper timing in the operation 322 is performed in a way similar to that described earlier with reference to web synchronization.

An arrangement (not shown) similar to that illustrated in FIG. 8 may be employed using a number of printing cylinders, for example in use in color printing where each of the imaging cylinders will print a different color.

It is to be again noted that the process described herein causes the printing of two separate images at substantially the same time, with one of the images being printed on one side of one substrate sheet and with the other image being primed on the other side of a second substrate sheet. For convenience, such printing is described in the specification as well as in the claims as a 'simultaneous' transfer of two images onto the two sides of a substrate, even though the imprinting of two sides of a particular substrate sheet takes place sequentially rather than at the same time.

In all of the above-described configurations, the cylinders are imaged by a light beam, typically a laser beam, spun across the cylinder surface with the help of a spinner, and imaged to a proper spot size by an f-theta lens. As shown in FIGS. 9*a*, 9*b*, 10*a* and 10*b*, the laser beam and associated spinner and f-theta lens may be replaced by LED arrays 400 and 404, 410 and 414, such as TPMP, commercially available from Telefunken Electronic GmbH, P.O. Box 1109, Heilbronn D-7100, Germany, or those described in an article by L. De Schaphelaare, "Single Pass Digital Color Priming in Duplex", published by Xeikon N.V. of Mortsel, Belgium, which is incorporated by reference as if fully set forth herein.

As will be readily appreciated, the substitution of LED arrays does not alter the other components of a method and system according to the present invention so that the descriptions of the configurations involving laser beam imaging apply, mutatis mutandis, to configurations based on LED arrays.

Alternatively, an electroluminescent device, such as TFEL Array, manufactured by Edge Emitter Technologies, Inc., Fremont, Calif., U.S.A., may be used, or a linear LCY shutter LISA such as manufactured by Philips BA, Eindhoven, Holland.

While the invention has been described with respect to a limited number of embodiments, it will be appreciated that many variations, modifications and other applications of the invention may be made.

What is claimed is:

1. A color printing apparatus for printing separate color images onto the two sides of a substrate, comprising:

(a) a plurality of image bearing surfaces each of said surfaces being related to a single color;

(b) an imaging mechanism for imaging each of said plurality of image bearing surfaces with at least two separate images related to said color printed by said image bearing surface;

(c) a plurality of transfer mechanisms for transferring each of said at least two separate images of each of said plurality of image bearing surfaces onto the substrate, with at least one of said at least two images being transferred to each side of the substrate, each of said at least two images being transferred to the substrate from a different location along each of said plurality of image bearing surfaces; and (d) a turnover mechanism for turning the substrate over between the transferring of the first of said two images of all of said plurality of image bearing surfaces and the transferring of the second of said two images.

2. An apparatus as in claim 1, wherein the substrate is a continuous-web substrate.

3. An apparatus as in claim 1, wherein the substrate is a sheet-fed substrate.

4. An apparatus as in claim 1, wherein said image bearing surface is an imaging cylinder.

5. An apparatus as in claim 1, wherein said image bearing surface is a photosensitive drum.

6. An apparatus as in claim 5, wherein said imaging mechanism includes a radiation source for writing the images onto said image bearing surface.

7. An apparatus as in claim 6, wherein said radiation source is a laser source.

8. An apparatus as in claim 6, wherein said radiation source is an array of liquid crystal shutters.

9. An apparatus as in claim 6, wherein said radiation source is an LED bar.

10. An apparatus as in claim 6, wherein said radiation source is an TFEL array.

11. An apparatus as in claim 6, wherein said radiation source is scanned across said image bearing surface using a spinner.

12. An apparatus as in claim 11, wherein said scanned radiation source is focused using an f-theta lens.

13. An apparatus as in claim 6, wherein, prior to said writing by said radiation source, said image bearing surface is charged by a corona discharge device.

14. An apparatus as in claim 6, wherein, following said writing by said radiation source, the image is developed.

15. An apparatus as in claim 14, wherein the image transferred is fixed using a fuser.

16. An apparatus as in claim 6, wherein the image is transferred to the substrate with the aid of a second corona discharge device.

17. An apparatus as in claim 1, wherein said image bearing surface is a magnetic sensitive drum.

18. An apparatus as in claim 17, wherein said imaging mechanism includes a magnetic head.

19. An apparatus as in claim 18, wherein, following said writing by said magnetic head, the image is developed.

20. An apparatus as in claim 2, wherein said image bearing surface is an electrical charge sensitive drum.

21. An apparatus as in claim 20, wherein said wherein said imaging mechanism includes an ion source.

22. An apparatus as in claim 21, wherein, following said writing by said ion source, the image is developed.

23. An apparatus as in claim 1, wherein said turnover mechanism includes turnover bars.

24. An apparatus as in claim 1, wherein said plurality of image bearing surfaces are imaging cylinders, at least two of said cylinders being of different diameters.

25. A color printing method for printing separate color images onto the two sides of a substrate, comprising the steps of:

(a) imaging a plurality of image bearing surfaces, each of said surfaces being related to a single color, with at least two separate images related to said color of said image bearing surface;

(c) transferring each of said at least two separate images of each of said plurality of image bearing surfaces onto the substrate, with at least one of said at least two images being transferred to each side of the substrate, each of said at least two images being transferred to the substrate from a different location along each of said plurality of image bearing surfaces; and (d) turning the substrate over between the transferring of the first of said two images of all of said plurality of image bearing surfaces and the transferring of the second of said two images.

* * * * *